US005358127A

United States Patent [19]

Ennis

[11] Patent Number: 5,358,127

[45] Date of Patent: Oct. 25, 1994

[54] SHAVER STAND

[76] Inventor: Barry A. Ennis, 46 Park Gate Dr., Edison, N.J. 08820

[21] Appl. No.: 162,644

[22] Filed: Dec. 3, 1993

[51] Int. Cl.[5] ..... A47F 7/00

[52] U.S. Cl. ..... 211/60.1; 211/65; D6/526

[58] Field of Search ..... 211/65, 60.1, 70.6, 211/69.5, 69.1, 69; D6/526, 528, 531, 534

[56] References Cited

U.S. PATENT DOCUMENTS

| | | | |
|---|---|---|---|
| D. 335,599 | 5/1993 | Novak | D6/526 |
| 2,117,459 | 5/1938 | Stanton | 211/65 |
| 2,568,089 | 9/1951 | Pendleton | 211/69 |
| 2,935,206 | 5/1960 | Smith | 211/65 |
| 2,987,194 | 6/1961 | Burge | 211/65 |
| 3,344,930 | 10/1967 | Merkel | 211/65 |

*Primary Examiner*—Robert W. Gibson, Jr.
*Attorney, Agent, or Firm*—Arthur L. Lessler

[57] ABSTRACT

A shaver stand which has a stepped configuration, with each step having a shallow recess for receiving the end of the handle of a razor. An elongated wire mesh structure is disposed above and parallel to the steps, for holding an intermediate part of each razor handle in place. From the top plan view the stand is V-shaped, having a wire front cross member joining the two sets of steps, the cross member having a portion for holding the shaver currently being used.

8 Claims, 2 Drawing Sheets

SHAVER STAND

BACKGROUND OF THE INVENTION

This invention relates to a stand for holding disposable shavers (razors) and other items of personal hygiene such as toothbrushes.

Various stands for holding disposable razors and other personal hygiene articles having elongated handles, such as toothbrushes, are known in the art. See, for example:

- Dufault U.S. Pat. No. D22,831, entitled Razor Holder;
- Fishback U.S. Pat. No. D48,061, entitled Barber's Cabinet;
- Chianco U.S. Pat. No. D50,237, entitled Barber's Cabinet;
- Seidel U.S. Pat. No. D150,469, entitled Razor Rack;
- Spencer U.S. Pat. No. D304,868, entitled Safety Razor and Stand;
- Novak U.S. Pat. No. D335,599, entitled Razor Holder;
- Pratt U.S. Pat. No. 2,523,921, entitled Protective Holder For Razors; and
- Brownson U.S. Pat. No. 3,945,499, entitled Storage Hook For Razor And Blades.

None of the prior art stands, racks or holders for razors, however, holds disposable razors in an upright position in a stable manner while facilitating rapid removal of the razors.

The Fishback and Chianco patents show stepped or sloped structures for holding razors, with each level having a recess for receiving the end of a razor. Neither of these references, however, has any structure for supporting the handles of the razors, so that the handles tend to wobble about and into each other to an unacceptable extent.

The Spencer and Novak patents show structures for supporting the handle of a single razor near its upper end. Neither of these structures, however, is suitable for holding multiple razors, and neither structure facilitates rapid removal of the razor.

The other references cited above likewise fail to meet the need for stable retention of multiple razors while facilitating rapid removal thereof.

Accordingly, an object of the present invention is to provide a stand which supports multiple razors (and/or other articles of personal hygiene having elongated handles) so that they do not fall or tilt close to or against each other, and can be rapidly removed for use.

SUMMARY OF THE INVENTION

As herein described there is provided a stand for holding personal hygiene articles having elongated parts. The stand has first and second legs, each leg having a bottom surface, substantially parallel side surfaces, a relatively low front part, a relatively high rear part, and a stepped top surface extending between said front and rear parts. Each step of the top surface of each leg has a recess adapted to receive a minor end portion of a handle of a personal hygiene article such as a razor or toothbrush, each such recess having an internal handle supporting surface disposed above the bottom surface of the corresponding leg. The rear parts of the legs are disposed adjacent one another, with the bottom surfaces of the legs substantially coplanar, and the side surfaces of one leg being at an acute angle to the side surfaces of the other leg. A cross member is connected between the front parts of the legs, the cross member having means for vertically receiving an end part of a handle of a personal hygiene article. First and second elongated mesh means are provided, each of the mesh means being secured to a front part of a corresponding one of the legs and extending above and in juxtaposition with the top surface thereof. Each mesh means has an opening above a corresponding recess for accommodating an intermediate portion of the handle of the personal hygiene article.

With this arrangement a personal hygiene article having an elongated handle may be held on each step by engagement of the end of the handle thereof with the corresponding supporting surface, the handle extending through an opening of the corresponding mesh means and being held upright by engagement therewith, and the article may be removed by grasping a portion of the handle extending above the corresponding mesh means.

IN THE DRAWING

DETAILED DESCRIPTION

Figure 1:
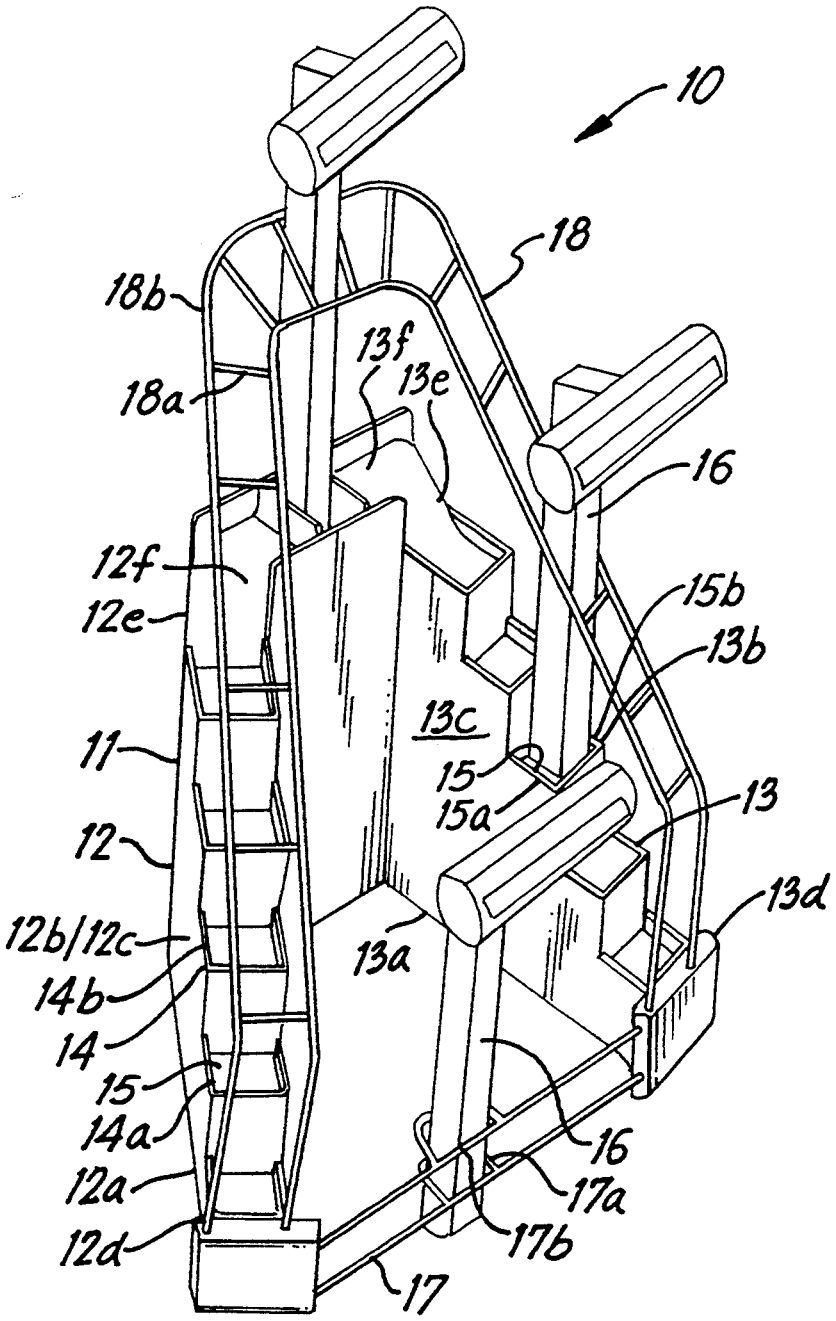
FIG. 1 is an isometric view of a shaver stand according to a preferred embodiment of the present invention.
Figure 2:
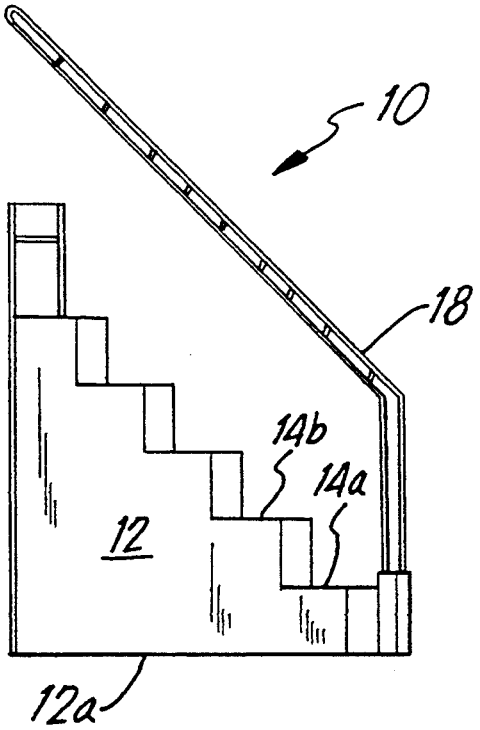
FIG. 2 is a left side elevation view thereof.
Figure 3:
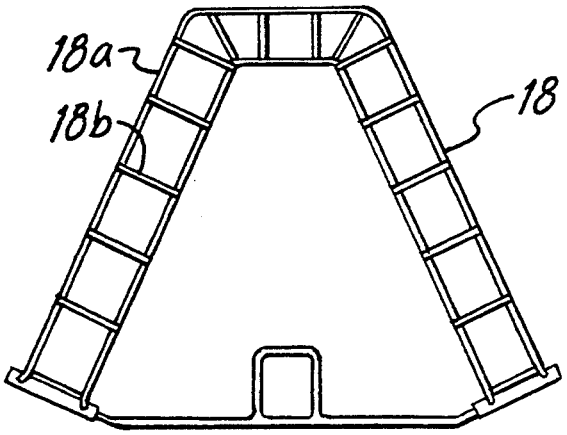
FIG. 3 is a top plan view thereof.

As seen in FIG. 1, a shaver stand 10 comprises a unitary plastic generally V-shaped structure 11 comprising first and second legs 12 and 13.

The structure 11 is preferably molded from a relatively rigid plastic such as an acrylic.

The legs 12 and 13 have bottom surfaces **12*a* and 13*a*, substantially parallel side surfaces 12*b*/12*c* and 13*b*/13*c*, relatively low front parts 12*d* and 13*d*, relatively high rear parts 12*e* and 13*e*, and stepped top surfaces 12*f* and 13*f*** extending tending between their front and rear parts respectively.

Each of the steps 14 of the top surfaces **12*f*, 13*f* of the legs 12 and 13 has a shallow recess 15 of generally rectangular cross-section. Each of the recesses 15 is adapted to receive a minor end portion of a handle of a disposable razor such as one of the razors 16**.

Each of the recesses 15 has a horizontal internal razor handle supporting surface **15*a* disposed above the bottom surface 12*a*, 13*a* of the corresponding leg 12, 13, and side walls 15*b*. The depth of each recess 15, i.e. the height of the walls 15*b*** is substantially less than any lateral dimension (length or width) thereof.

The depth of each of the recesses 15 is preferably in the range of $\frac{1}{8}$ inch to $\frac{3}{8}$ inch. This depth is sufficient to retain a minor end part of a razor handle, while not obstructing rapid removal of the razor from the stand.

The legs 12, 13 are disposed with their rear parts **12*e*, 13*e*** adjacent one another and preferably blending into each other.

The bottom surfaces **12*a*, 13*a* of the legs 12, 13 are substantially coplanar, so that the stand 10** may rest on a horizontal surface.

The side surfaces **12*b*, 12*c* of the leg 12 are at an acute angle to the side surfaces 13*b*, 13*c* of the leg 13**.

A wire-like cross member 17 is connected between the front parts **12*d*, 13*d* of the legs 12 and 13. The cross member 17 has upper and lower ring-shaped, vertically aligned parts 17*a* and 17*b*** for vertically receiving an end part of a handle of a disposable razor.

A unitary generally V-shaped wire mesh structure 18 is connected at one end to the front part **12*d* of the leg 12, and at the other end to the front part 13***d* of the leg 13.

The mesh structure 18 has elongated mesh parts 18*a* and 18*b*. The mesh part 18*a* extends above and in juxtaposition with the top surface 12*f* of the leg 12, while the mesh part 18*b* extends above and in juxtaposition with the top surface 13*f* of the leg 13.

The mesh parts are aligned with the underlying stepped surfaces, i.e. the steps 14*a*, 14*b* so that each mesh part has an opening vertically above a corresponding one of the recesses 15, wherein each such opening in the mesh parts is adapted to accommodate an intermediate portion of a razor handle.

With the shaver stand 10 so constructed, disposable razors 16 are held on corresponding ones of the steps 14 by engagement of the ends of the shaver handles with the corresponding recessed supporting surfaces 15*a* and recess walls 15*b*; with the razor handles extending through corresponding openings of the mesh parts 18*a*, 18*b*; each handle being held upright by engagement with the wire of the mesh part surrounding the corresponding opening.

Thus each razor is held upright at the end of the razor handle and at an intermediate portion of the handle, so that the razor may be rapidly removed by grasping a portion of the handle extending above the mesh structure 18.

The shaver stand 10 may also be used to hold toothbrushes, or a mix of disposable shavers and toothbrushes; and may also hold other items of personal hygiene having elongated handles.

If desired, two persons may share use of the stand, with one person having the use of the part of the stand comprising leg 12 the associated mesh part 18*a*, and the other person having the use of the part of the stand comprising leg 13 the associated mesh part 18*b*.

We claim:

1. A shaver stand, comprising:

first and second legs each having a bottom surface, substantially parallel side surfaces, a relatively low front part, a relatively high rear part, and a stepped top surface extending between said front and rear parts, each step of said top surface having a recess adapted to receive a minor end portion of a handle of a disposable razor, each such recess having an internal razor handle supporting surface disposed above the bottom surface of the corresponding leg, said legs being disposed with their rear parts adjacent one another, their bottom surfaces substantially coplanar, and the side surfaces of one leg being at an acute angle to the side surfaces of the other leg;

a cross member connected between said front parts, said cross member having means for vertically receiving an end part of a handle of a disposable razor; and first and second elongated mesh means, each of said mesh means being secured to a front part of a corresponding one of said legs and extending above and in juxtaposition with the top surface thereof, each mesh means having an opening above a corresponding recess for accommodating an intermediate portion of said handle, whereby a disposable razor may be held on each step by engagement of the end of the handle thereof with the corresponding supporting surface, the handle extending through an opening of the corresponding mesh means and being held upright by engagement therewith, and the razor may be removed by grasping a portion of the handle extending above the corresponding mesh means.

2. The shaver stand according to claim 1, wherein said legs comprise plastic and said cross member and mesh means comprise wire.

3. The shaver stand according to claim 1, wherein the depth of each recess is less than 0.25 inch.

4. The shaver stand according to claim 1, wherein said rear parts of said legs are integral with each other.

5. The shaver stand according to claim 1, wherein said first and second mesh means are integral with each other and supported only at the front parts of the corresponding legs.

6. The shaver stand according to claim 1, wherein each such recess has a generally rectangular cross-section.

7. A shaver stand, comprising:

a unitary structure comprising first and second legs each having a bottom surface, substantially parallel side surfaces, a relatively low front part, a relatively high rear part, and a stepped top surface extending between said front and rear parts, each step of said top surface having a shallow recess of generally rectangular cross-section adapted to receive a minor end portion of a handle of a disposable razor, each such recess having a horizontal internal razor handle supporting surface disposed above the bottom surface of the corresponding leg, the depth of each such recess being substantially less than any lateral dimension thereof said legs being disposed with their rear parts adjacent one another, their bottom surfaces substantially coplanar, and the side surfaces of one leg being at an acute angle to the side surfaces of the other leg;

a wire-like cross member connected between said front parts, said cross member having means for vertically receiving an end part of a handle of a disposable razor; and a unitary generally V-shaped mesh structure comprising first and second elongated mesh parts, each of said mesh parts being secured to a front part of a corresponding one of said legs and extending above and in juxtaposition with the top surface thereof, each mesh part having an opening above a corresponding recess for accommodating an intermediate portion of said handle, whereby a disposable razor may be held on each step by engagement of the end of the handle thereof with the corresponding supporting surface, the handle extending through an opening of the corresponding mesh part and being held upright by engagement therewith, and the razor may be removed by grasping a portion of the handle extending above the corresponding mesh part.

8. A stand for holding personal hygiene articles having elongated parts, comprising:

first and second legs each having a bottom surface, substantially parallel side surfaces, a relatively low front part, a relatively high rear part, and a stepped top surface extending between said front and rear parts, each step of said top surface having a recess adapted to receive a minor end portion of a handle of a personal hygiene article, each such recess having an internal handle supporting surface disposed above the bottom surface of the corresponding leg, said legs being disposed with their rear parts adjacent one another, their bottom surfaces substantially coplanar, and the side surfaces of one leg being at an acute angle to the side surfaces of the other leg;

a cross member connected between said front parts, said cross member having means for vertically receiving an end part of a handle of a personal hygiene article; and first and second elongated mesh means, each of said mesh means being secured to a front part of a corresponding one of said legs and extending above and in juxtaposition with the top surface thereof, each mesh means having an opening above a corresponding recess for accommodating an intermediate portion of said handle, whereby a personal hygiene article having an elongated handle may be held on each step by engagement of the end of the handle thereof with the corresponding supporting surface, the handle extending through an opening of the corresponding mesh means and being held upright by engagement therewith, and the article may be removed by grasping a portion of the handle extending above the corresponding mesh means.

* * * * *